US010066342B2

(12) United States Patent
Lasell et al.

(10) Patent No.: US 10,066,342 B2
(45) Date of Patent: Sep. 4, 2018

(54) WET-LAID NONWOVEN INCLUDING THERMOPLASTIC FIBER

(71) Applicant: Lydall, Inc., Manchester, CT (US)

(72) Inventors: Casey James Lasell, Laconia, NH (US); Jeff Daval Miller, Durham, NH (US)

(73) Assignee: Lydall, Inc., Manchester, CT (US)

( * ) Notice: Subject to any disclaimer, the term of this patent is extended or adjusted under 35 U.S.C. 154(b) by 255 days.

(21) Appl. No.: 14/974,130

(22) Filed: Dec. 18, 2015

(65) Prior Publication Data

US 2016/0177510 A1 Jun. 23, 2016

Related U.S. Application Data

(60) Provisional application No. 62/093,560, filed on Dec. 18, 2014.

(51) Int. Cl.

| | |
|---|---|
| ***D21H 17/37*** | (2006.01) |
| ***D21H 13/38*** | (2006.01) |
| ***D21H 13/24*** | (2006.01) |
| ***D04H 1/60*** | (2006.01) |
| ***D04H 1/64*** | (2012.01) |

(Continued)

(52) U.S. Cl.

CPC ..... *D21H 13/38* (2013.01); *D04H 1/4209* (2013.01); *D04H 1/541* (2013.01); *D04H 1/587* (2013.01); *D04H 1/60* (2013.01); *D04H 1/64* (2013.01); *D04H 1/732* (2013.01); *D21H 13/24* (2013.01); *D21H 13/36* (2013.01); *D21H 17/37* (2013.01); *D10B 2101/06* (2013.01); *D10B 2101/08* (2013.01); *D10B 2331/04* (2013.01); *D10B 2331/041* (2013.01); *D10B 2505/00* (2013.01)

(58) Field of Classification Search

None

See application file for complete search history.

(56) References Cited

U.S. PATENT DOCUMENTS

| | | | | |
|---|---|---|---|---|
| 2,702,261 A | | 8/1950 | Bacon et al. | |
| 4,861,653 A | * | 8/1989 | Parrish | D01D 5/18 264/29.2 |

(Continued)

FOREIGN PATENT DOCUMENTS

| | | |
|---|---|---|
| EP | 0465203 B1 | 3/1996 |
| EP | 0834936 A1 | 4/1998 |

(Continued)

OTHER PUBLICATIONS

WO International Search Report and Written Opinion—PCT Application No. PCT/US2015/066709, p. 5 list of references cited, dated Mar. 23, 2016.

(Continued)

*Primary Examiner* — Dennis R Cordray

(74) *Attorney, Agent, or Firm* — Moyles IP, LLC

(57) ABSTRACT

According to an aspect, the present embodiments may be associated with a wet-laid, nonwoven material including high temperature refractory fibers and thermoplastic fibers formed into the nonwoven material using a wet-laid process. In an embodiment, a fluoropolymer is included in the nonwoven material. In an embodiment, the refractory fibers are at least partially cleaned of shot and latex binder or binder fiber is eliminated or at least substantially reduced.

19 Claims, 6 Drawing Sheets

(51) Int. Cl.

| | |
|---|---|
| ***D04H 1/732*** | (2012.01) |
| ***D04H 1/587*** | (2012.01) |
| ***D04H 1/4209*** | (2012.01) |
| ***D04H 1/541*** | (2012.01) |
| ***D21H 13/36*** | (2006.01) |

(56) References Cited

U.S. PATENT DOCUMENTS

| | | | | |
|---|---|---|---|---|
| 4,889,764 | A | 12/1989 | Chenoweth et al. | |
| 4,946,738 | A | 8/1990 | Chenoweth et al. | |
| 5,053,107 | A | 10/1991 | Barber, Jr. | |
| 5,162,153 | A | 11/1992 | Cooke et al. | |
| 6,497,950 | B1 | 12/2002 | Haile et al. | |
| 6,733,628 | B2 * | 5/2004 | Dinwoodie | B01J 35/06 162/145 |
| 7,582,132 | B2 | 9/2009 | Jaffee | |
| 7,878,301 | B2 | 2/2011 | Gross et al. | |
| 7,918,313 | B2 | 4/2011 | Gross et al. | |
| 8,834,759 | B2 | 9/2014 | Lalouch et al. | |
| 2003/0041626 | A1 | 3/2003 | Yang et al. | |
| 2003/0201082 | A1 | 10/2003 | Kinsley, Jr. | |
| 2004/0161993 | A1 | 8/2004 | Tripp et al. | |
| 2005/0115662 | A1 | 6/2005 | Haque et al. | |
| 2006/0242933 | A1 | 11/2006 | Webb et al. | |
| 2010/0207298 | A1 * | 8/2010 | Kunze | D04H 1/4218 264/321 |
| 2010/0209308 | A1 | 8/2010 | Kunze et al. | |
| 2011/0247839 | A1 * | 10/2011 | Lalouch | A62C 2/06 169/45 |
| 2013/0244525 | A1 | 9/2013 | Chacko et al. | |
| 2014/0262088 | A1 * | 9/2014 | Deka | D21H 13/24 162/146 |

FOREIGN PATENT DOCUMENTS

| | | | |
|---|---|---|---|
| EP | 2322866 | A1 | 11/2009 |
| EP | 2422866 | A1 | 2/2012 |
| WO | WO200123655 | A1 | 4/2001 |
| WO | WO-2009048859 | A1 | 4/2009 |
| WO | WO-2014160089 | A1 | 10/2014 |

OTHER PUBLICATIONS

Hapuarachchi, et al. Fire Retardancy of Natural Fibre Reinforced Sheet Moulding Compound (Abstract), Applied Composite Materials, Jul. 2007 vol. 14 Issue 4 pp. 251-264.

Lydall, Lytherm Grade 970-L, Utility Grade Paper, Product Information Sheet, revised May 3, 2010.

Patel, et al., Nonwoven Technology for Unconventional Fabrics, retrieved Nov. 28, 2014.

Unifrax LLC, Fiberfrax Blanket and Mat Products, Product Information Sheet, Oct. 2010.

Gennrich, High Temperature Ceramic Fiber Filter Bags (Abstract), Gas Cleaning at High Temperatures, 1993, pp. 307-320, by Springer Science+Business Media Dordrecht.

Bajaj, Thermally Sensitive Materials (Chapter 4), Smart Fibres, Fabrics and Clothing: Fundamentals and Applications, edited by X M Tao, pp. 58-80, Jan. 2001.

Hegde, et al., Bicomponent Fibers, available at http://www.engr.utk.edu/mse/Textiles/Bicomponent%20fibers.htm, updated Apr. 2004.

Fuerda, Thermal Insulation Ceramic Fiber Blanket for Boilers, Product Details, retrieved Nov. 28, 2014.

Morgan Advanced Materials, Thermal Ceramics, Superwool Bulks, Product Datasheet, Code US: 1114-100, retreived Jan. 29, 2015, www.morganthermalceramics.com.

Wikipedia, Carbon Fibers, Feb. 14, 2018, 7 pgs., https://en.wikipedia.org/wiki/Carbon_fibers.

Science Direct, Mechanical properties of carbon fiber/cellulose composite papers, Feb. 2014, 5 pgs., https://www.sciencedirect.com/science/article/pii/S1002007114000070.

Technical Textile, Wetlaid, 2018, 2 pgs., http://www.technicaltextile.net/nonwovens/wetlaid/index.aspx.

Hollingsworth & Vose, Wet Laid, Nov. 7, 2012, 2 pgs., https://www.hollingsworth-vose.com/en/Innovation/Process-Capabilities/Wet-Laid/.

* cited by examiner

WET-LAID NONWOVEN INCLUDING THERMOPLASTIC FIBER

CROSS-REFERENCE TO RELATED APPLICATIONS

This application claims benefit of U.S. Provisional Application No. 62/093,560 filed Dec. 18, 2014, which is incorporated herein by reference in its entirety.

FIELD

A wet-laid, nonwoven material for use as an insulating material is generally described in which high temperature refractory fibers and thermoplastic fibers are formed into the nonwoven material using a wet-laid process.

BACKGROUND

Insulating materials made from nonwoven materials are well known that are suitable for use in structures such as buildings, appliances, and automotive applications to provide thermal and/or acoustical insulation. Depending on the desired features required of the end-product, such nonwoven materials have been made from various constituents.

One such nonwoven material is made using cellulose fibers, with or without blends of other fibers, and typically requires some sort of binder. Such cellulose-containing insulating materials are typically made using dry- or air-laid processes, that is, by typical papermaking processes, and the binder is applied as a spray or foam. It is also possible to add other fibers to aid in binding the cellulose fibers, which are activated and cured by heat to help form the nonwoven material.

It is also well known to make such insulating materials with synthetic fibers, such as polyester fibers. It is possible to make these materials using wet-laid processes. Such insulating materials typically include water-based binders, typically in the form of a latex binder, which are added to the process to ensure adhesion of the fibers. The binder is typically sprayed on, beater added or saturated with a binder solution. Generally, from about 4% to about 35% binder material is employed. Applying latex binder, by for instance spraying the binder onto one or more surfaces of the nonwoven web, can result in a thickness of latex binder buildup on the surface, which lends towards unwanted stiffness of the web. Further, binder migration can occur, meaning that the latex binder moves through the sheet unevenly, and pools, for instance, at outer edges thereof.

In addition, many gasket manufacturers have moved away from conventional die cutting and replaced these systems with more modern water jet cutting systems. These systems are significantly more productive and profitable than their die cutting counterparts. Unfortunately water jet cutting can present technical complications when handling nonwoven materials that include refractory fibers. Examples of typical refractory fibers include ceramic fibers and manmade vitreous fibers. Such refractory fibers are extremely hydrophilic and have a tendency to soak up tremendous amounts of liquid, typically water, for their mass. During the water jet cutting process, a water laden nonwoven material including such refractory fibers is capable of absorbing enough water to sufficiently compromise the mechanical strength of the material. This loss in strength can lead to downstream process issues and increased scrap.

In materials made from synthetic and/or cellulose fibers, the non-binder fibers typically make up the largest portion of the material. That is, the cellulose and synthetic fibers are used as the main portion of the nonwoven material, typically making up over 50 wt. % of the overall composition, which is expensive to make.

It is also known to make nonwoven webs using glass and/or ceramic fibers. As would be understood by one of ordinary skill in the art, during production of ceramic fibers, for instance, relatively large ceramic beads, known as "shot," may be pulled into the ceramic fiber material. While the thus-produced shot has the same chemical makeup of the ceramic fibers, the resulting structures and functionality in use are markedly different. Such shot are typically considered undesirable in the nonwoven material because such shot tend to conduct heat more readily than the thin ceramic fibers and generally lead to uneven distribution of the ceramic fibers across the resulting nonwoven web or material. Various attempts have been made to produce nonwoven webs with minimum shot, but such methods have typically employed air-laid, needling and/or gravity-laid processes, typically with the addition of a latex binder or binder fiber. Many advantages can be found in wet-laid structures, as compared to structures made from these other processes, including but not limited to the ability to form lower basis weight materials having uniform distribution of fibers and favorable density, without breaking fibers. This leads to improvements in strength and thermal properties, to name a few. Additionally, it is simply difficult to make thick glass-/ceramic-fiber-based media using such processes. In fact, as would be understood by one of ordinary skill in the art, such processes are typically capable of making useful glass-/ceramic-fiber-based media with thicknesses around 1/32 inch (0.8 mm), and typically no greater than about 0.125 inches (3.175 mm), without resulting in cracking of the media. When used in appliances, such glass-/ceramic-fiber-based media advantageously take the form of various products including but not limited to parting paper, gasketing material, hot-spot management materials, and the like.

Yet another problem identified with using ceramic fibers is the potential for such fibers to become airborne and to become carcinogenic if inhaled. The European Community (EC) classified Refractory Ceramic Fiber as a carcinogen 2 in 1997, and the classification came into effect in 2007. Carcinogen 2 is class 1B material under the EC's Registration, Evaluation, Authorisation and Restriction of Chemicals (REACH) regulations, or a "Substance of very high concern."

Addition of latex binders and/or binder fibers to nonwoven webs also has known problems. A non-limiting example of a binder fiber is a PVOH binder fiber, (which essentially dissolves when processed and dries in a similar fashion to a latex binder). As used herein, the term "binder fibers" excludes thermoplastic fibers, e.g., "monocomponent fibers," and "bicomponent fibers", as defined in greater detail hereinbelow. In the case where the latex binders are added using a sprayed-on method results in abysmal latex yield, meaning that much of the latex is essentially washed-out in the process. Thus, costs of raw materials are needlessly higher, as are the clean-up costs of removing the latex from the wastewater to abate environmental issues. Furthermore, latex binders and/or binder fibers are not always evenly distributed, leading to material frailty and manufacturing difficulty. Thus, minimizing, or even eliminating latex binders and/or binder fibers is desirable.

Although addition of thermoplastic bicomponent fibers, that is fibers typically having a core and a sheath, typically having differing melting points, in addition to or in place of the latex binder are known, there are problems associated therewith, particularly when attempting to incorporate such bicomponent fibers using a wet-laid process. One such problem has been achieving a uniform dispersion of the bicomponent fibers in the resulting nonwoven material.

With reference to FIG. 1, a wet-laid nonwoven web 10 according to the prior art is depicted in a highly stylized fashion. The web 10 was made from a wet-laid process in which, for instance, ceramic fibers 12 containing shot 16, as supplied from the manufacturer, (e.g. not cleaned to remove shot), is wet-laid to form the nonwoven web 10. Upon formation of the nonwoven web 10, binder, for instance latex binder, is sprayed onto the web and dried. As shown herein, the binder forms bonding points 18 between the ceramic fibers 12 and/or the shot 16.

In view of the disadvantages associated with currently available insulating materials, there remains a need for a material that minimizes or eliminates use of such binder additives, while maintaining desired properties, that is, sustains the form and strength of the material without becoming too stiff, and having a better raw material yield than previous methods. It may be advantageous in some applications to also impart a degree of water repellency to the nonwoven material.

BRIEF DESCRIPTION

According to an aspect, the present embodiments may be associated with wet-laid, nonwoven materials including high temperature refractory fibers and thermoplastic fibers formed into the nonwoven material using a wet-laid process. In an embodiment, a fluoropolymer is included in the nonwoven material. In an embodiment, the refractory fibers are at least partially cleaned of shot and latex binder or binder fiber is eliminated or at least substantially reduced.

BRIEF DESCRIPTION OF THE FIGURES

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

DETAILED DESCRIPTION

Reference will now be made in detail to various embodiments. Each example is provided by way of explanation, and is not meant as a limitation and does not constitute a definition of all possible embodiments.

Figure 1:
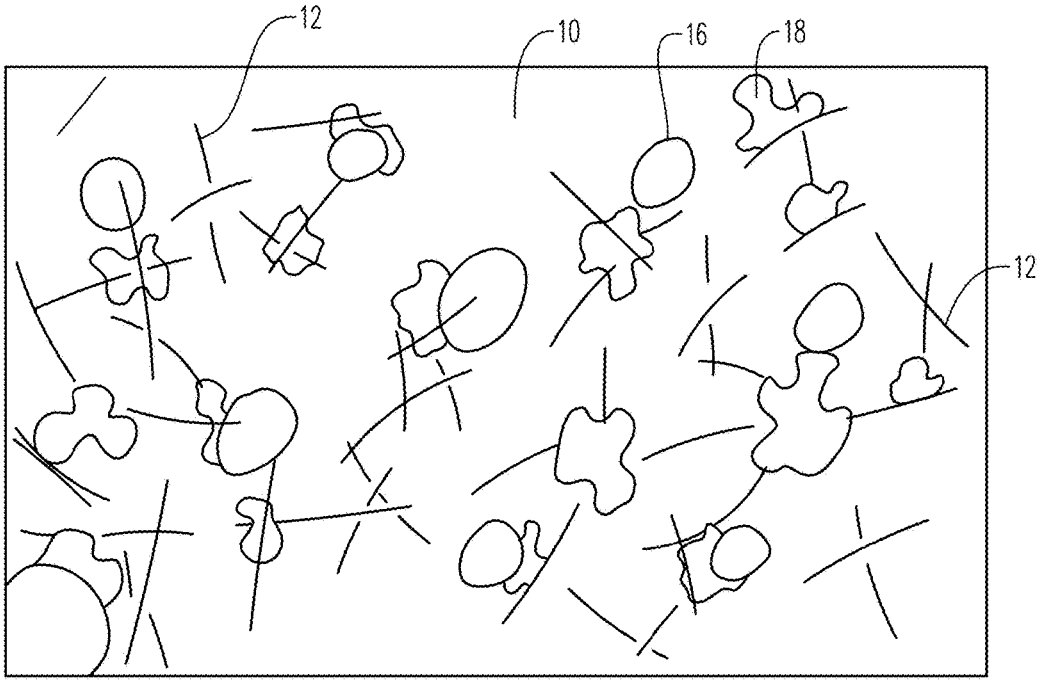
FIG. 1 (PRIOR ART)
FIG. 1 is a schematic cross-sectional view of a wet-laid nonwoven web according to the prior art.
Figure 2:
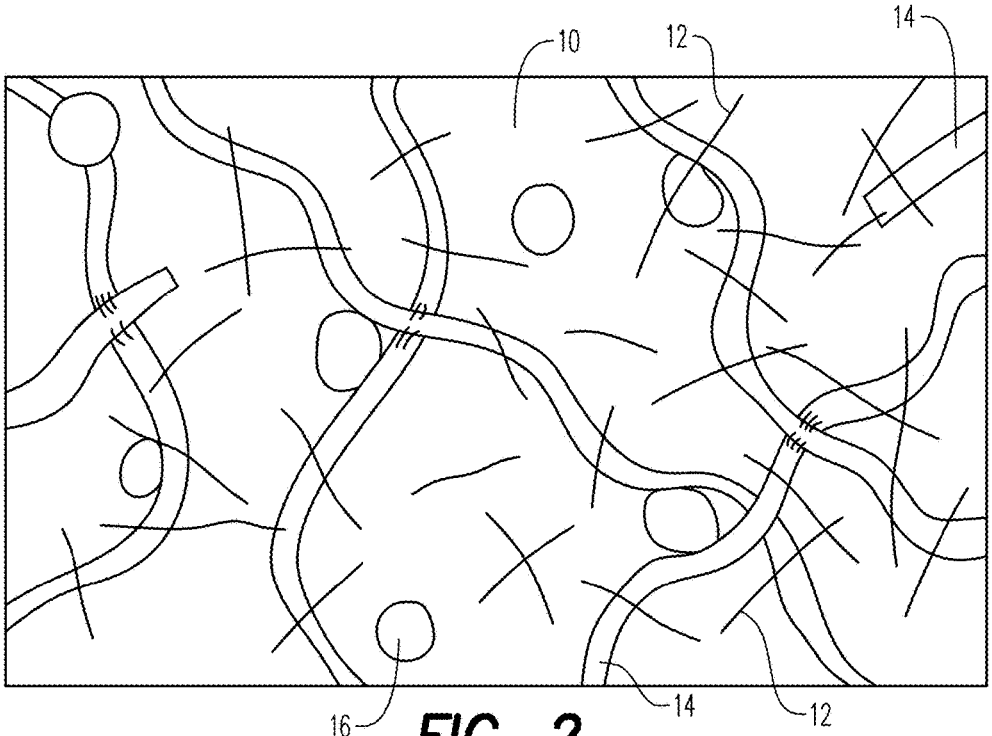
FIG. 2 is a schematic cross-sectional view of a wet-laid nonwoven web according to an embodiment.

Disclosed herein and with reference to FIG. 2 are wet-laid, nonwoven materials 10 that are particularly useful as insulating materials. Particularly, disclosed herein are materials 10 including high temperature refractory fibers 12 and thermoplastic fibers 14 formed into the nonwoven material or web 10 using a wet-laid process. In an embodiment, the refractory fibers 12 are at least partially cleaned of shot 16, and latex binder or binder fiber is eliminated (to render the material binderless) or at least substantially reduced, as described in more detail hereinbelow.

As used herein, the term "thermoplastic fibers," includes e.g., "monocomponent fibers," which includes fibers made from a single compound of a thermoplastic resin, such as coPET and "bicomponent fibers," while the term "bicomponent fibers" includes fibers having at least two different compounds, and in which each compound has differing melting points. Typically, such bicomponent fibers are fibers having at least two distinct cross-sectional domains respectively formed of different compounds or polymers. The term "bicomponent fiber" is thus intended to include concentric and eccentric sheath-core fiber structures, symmetric and asymmetric side-by-side fiber structures, island-in-sea fiber structures and pie wedge fiber structures, while a non-limiting example of a bicomponent or bico fiber is a fiber having a co-PET sheath and a PET core, wherein the core has a higher melting temperature than the sheath, as discussed in greater detail hereinbelow, (which maintains a fibrous shape in the resulting nonwoven web and participates as a fiber in the structure and performance of the nonwoven web).

Figure 3:
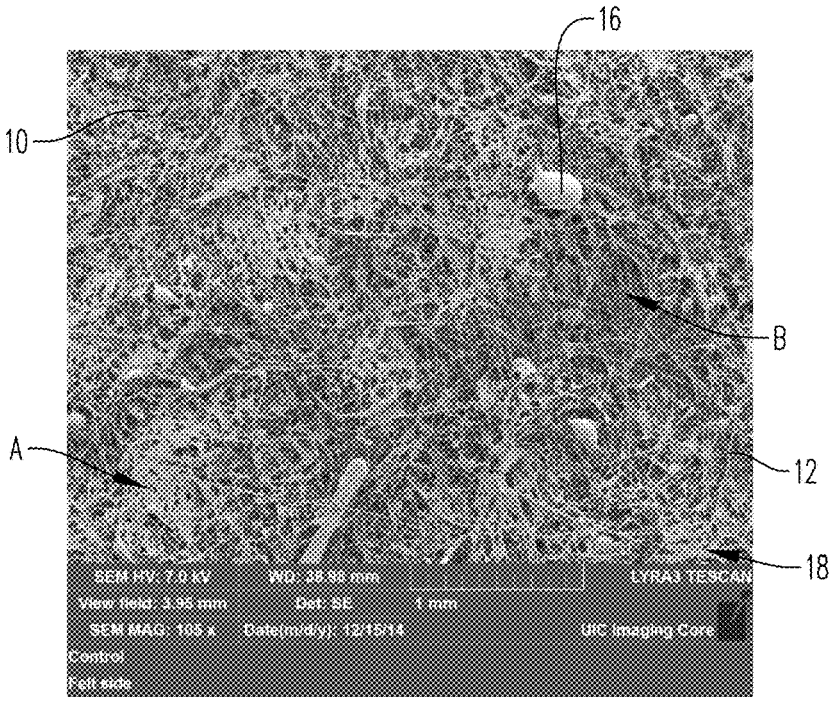
FIG. 3 (PRIOR ART)
FIG. 3 is an SEM photograph of a cross-section of a wet-laid nonwoven web according to the prior art shown at a magnification of 105×.
Figure 4:
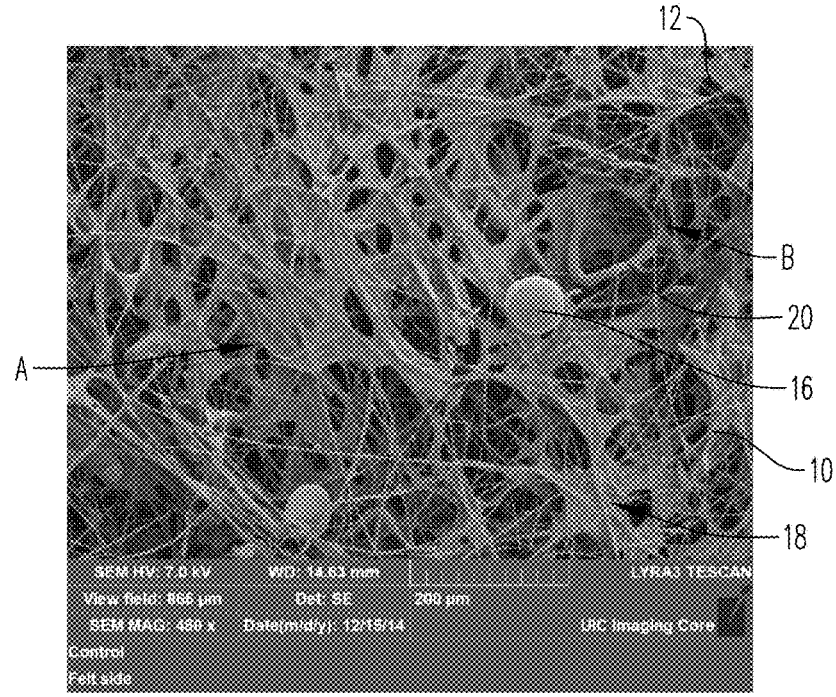
FIG. 4 (PRIOR ART)
FIG. 4 is an SEM photograph according to FIG. 3, shown at a greater magnification of 480×.

With reference to FIG. 3, a Scanning Electron Microscope (SEM) photograph of a wetlaid nonwoven material 10 according to the prior art is shown at a magnification of 105×. In this image, a felt side of 970LK, commercially available by Lydall Performance Materials, Inc. and as described with respect to the Comparative Example hereinbelow was scanned. The web 10 includes ceramic fibers 12 containing shot 16, and bonding points 18 can be clearly seen from the latex binder addition. Large ceramic shot particles 16 are readily apparent, and there are also areas of varying density of binder deposition depicted generally in the regions labeled "A" (overly dense binder deposition) and "B" (binder deposition less dense). FIG. 4 depicts the SEM image of FIG. 3 at a greater magnification of 480×. This view provides a clearer image of the shot particles 16, uneven binder deposition areas A and B, and partially cured PVOH binder fiber 20.

Figure 5:
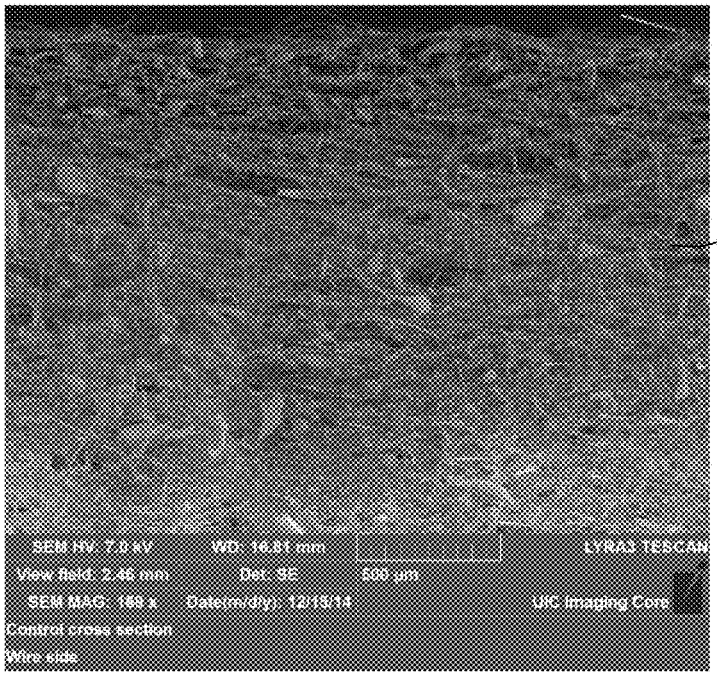
FIG. 5 (PRIOR ART)
FIG. 5 is an SEM photograph of a cross-section of a wet-laid nonwoven web according to the prior art shown at a magnification of 169×.

FIG. 5 is an SEM photograph of a cross-section of the wet-laid nonwoven web 10 according to the prior art shown at a magnification of 169×. In this view, the cross section of standard 970LK starting on a wire side and transitioning towards a center of the material can be seen. As shown herein, poor binder distribution is evidenced by density gradient in the media. The loftier area would have more binder than the center where the fibers are more densely packed, and appear almost dusty.

Figure 6:
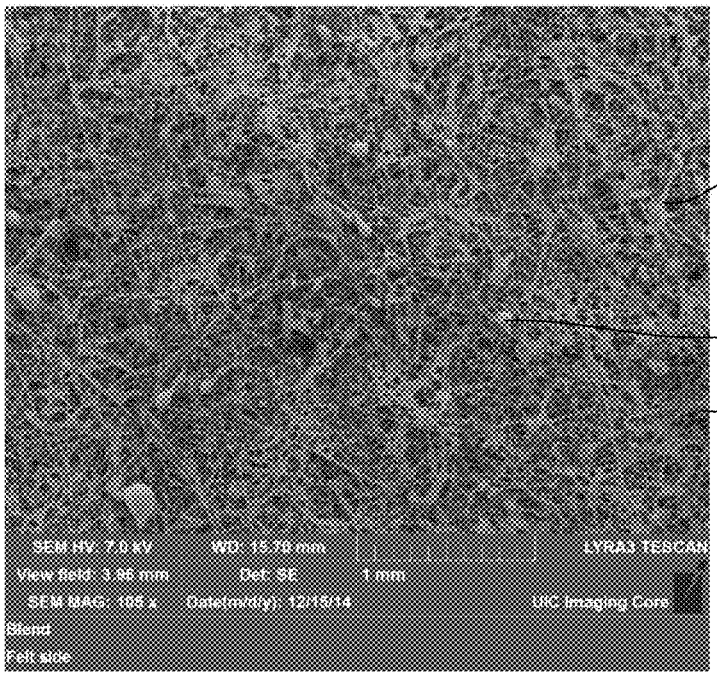
FIG. 6 is an SEM photograph of a cross-section of a wet-laid nonwoven web according to an embodiment shown at a magnification of 105×.

FIG. 6 is an SEM photograph of a cross-section of a wet-laid nonwoven web 10 according to an embodiment shown at a magnification of 105×. This view depicts a felt side view according to Example 2 described in detail hereinbelow, which includes 60 wt. % ceramic fiber, 32.6 wt. % ceramic fiber shot, 3.48 wt. % bicomponent fiber, 3.87 wt. % binder and <1 wt. % moisture. In this nonwoven material 10, a fairly evenly distributed binder deposition is evident along with shot particles 16. Also, large bicomponent fibers 14 are evenly distributed in the fiber matrix.

Figure 7:
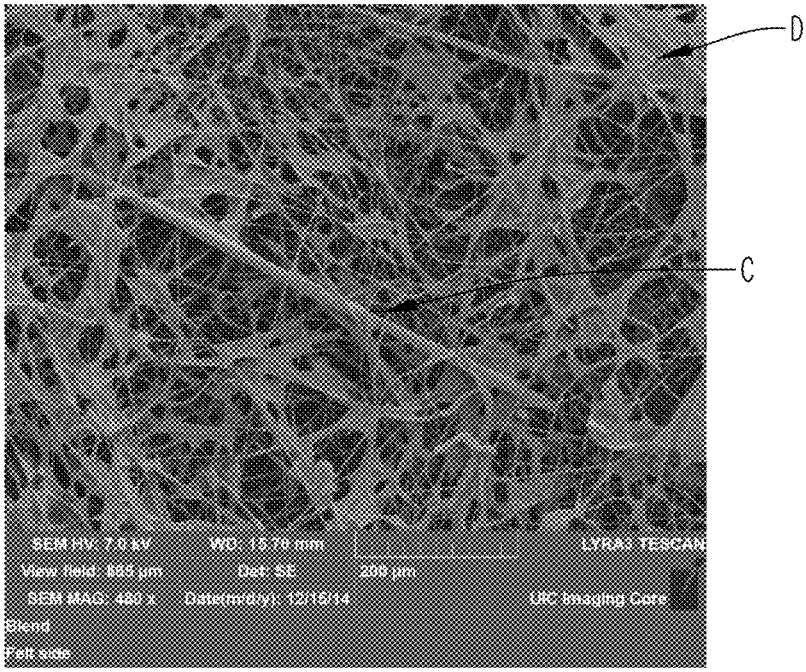
FIG. 7 is an SEM photograph according to FIG. 6, shown at a greater magnification of 480×.

FIG. 7 is an enlarged SEM photograph of FIG. 6, shown at a magnification of 480×, which clearly shows bicomponent fiber bonding at "C" and even binder deposition at "D".

Figure 8:
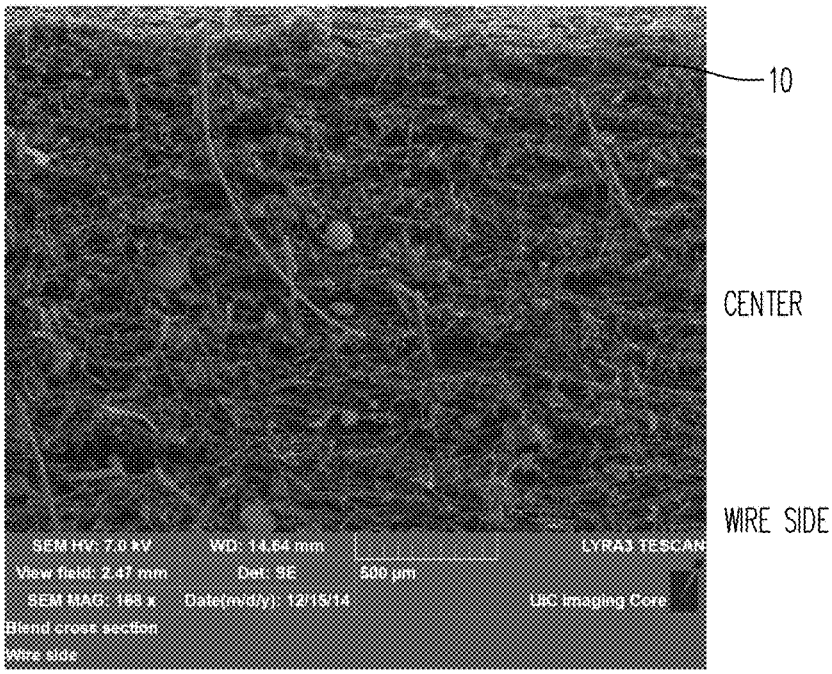
FIG. 8 is an SEM photograph of a cross-section of a wet-laid nonwoven web according to an embodiment shown at a magnification of 168×.

FIG. 8 is an SEM photograph of a cross-section of the wet-laid nonwoven web 10 according to the embodiment described as Example 2 shown at a magnification of 168×. In this view, the cross section of the nonwoven material 10 starting on the wire side and transitioning towards the center can be seen. Binder distribution appears much more uniform, while the bicomponent fibers are evenly distributed throughout the thickness.

Figure 9:
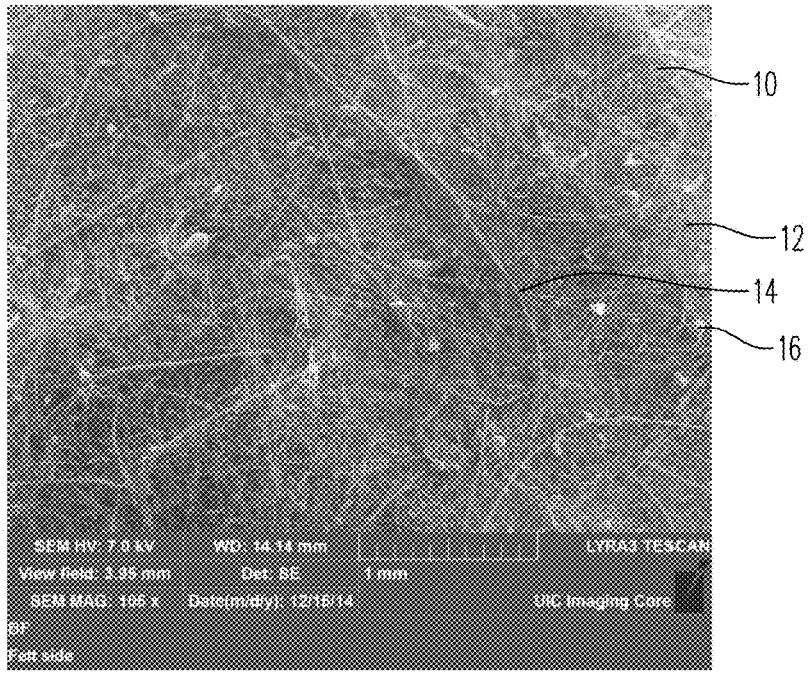
FIG. 9 is an SEM photograph of a cross-section of a wet-laid nonwoven web according to an embodiment shown at a magnification of 105×.

FIG. 9 is an SEM photograph of a cross-section of a wet-laid nonwoven web 10 according to an embodiment shown at a magnification of 105×. This view depicts a felt side view according to Example 1 described in detail hereinbelow, which includes 60.3 wt. % ceramic fiber, 32.8 wt. % ceramic fiber shot, 6.94 wt. % bicomponent fiber, and <1 wt. % moisture, while being binderless. In this nonwoven material 10, the shot particles 16 are still evident, but there are no areas of dense binder deposition since binder is absent from the material. The bicomponent fibers 14 are also evenly distributed.

Figure 10:
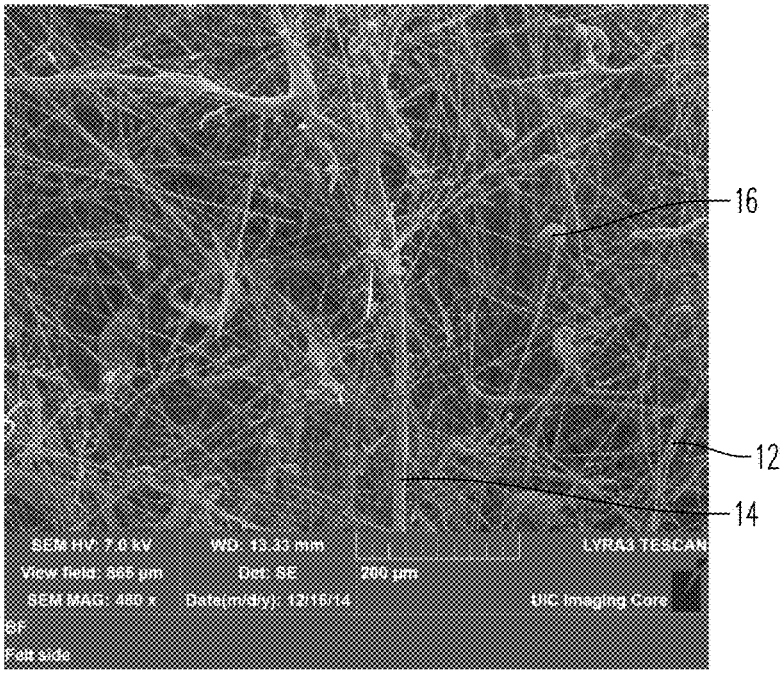
FIG. 10 is an SEM photograph according to FIG. 9, shown at a greater magnification of 480×.

FIG. 10 is an enlarged SEM photograph of the material of FIG. 9, shown at a magnification of 480×. This image shows connections between and even distribution of the bicomponent fibers 14 and the ceramic fibers 12.

Figure 11:
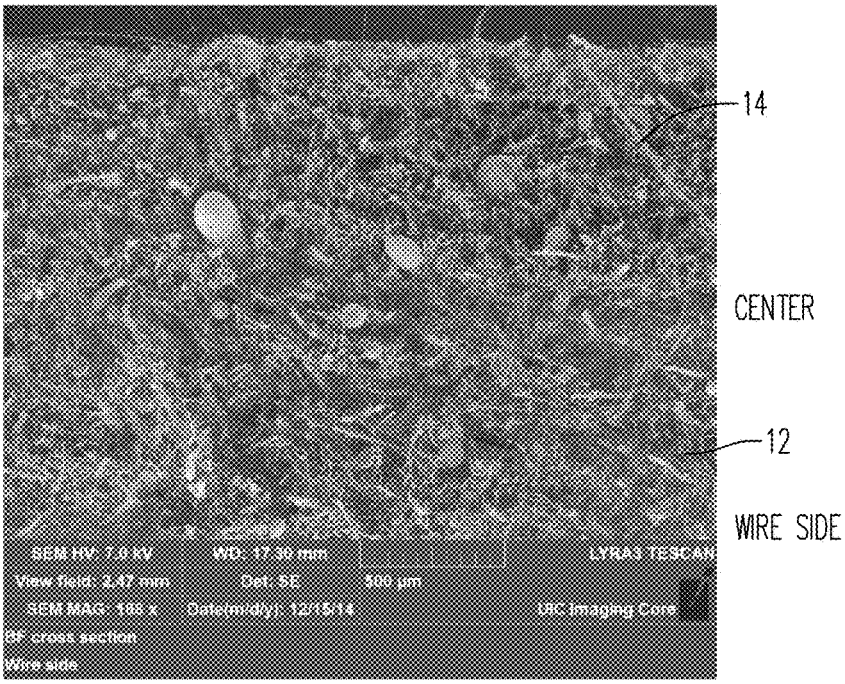
FIG. 11 is an SEM photograph of a cross-section of a wet-laid nonwoven web according to an embodiment shown at a magnification of 168×.

FIG. 11 is an SEM photograph of a cross-section of the wet-laid nonwoven web 10 according to the embodiment described as Example 1 shown at a magnification of 168×. In this view, the cross section of the nonwoven material 10 starting on the wire side and transitioning towards the center can be seen. The bicomponent fibers 14 and the ceramic fibers 12 appear extremely uniform in distribution, while maintaining a uniform density through the nonwoven material.

According to an embodiment, the wet-laid nonwoven material includes at least about 5-95 wt. % high temperature refractory fiber, at least about 1-10 wt. % bicomponent fiber, an amount of latex binder not to exceed about 9 wt. %, wherein the nonwoven material has a shot content of greater than about 5% to about 50%.

The high temperature refractory fibers include but are not limited to ceramic fibers, glass fibers, silica fibers, alumina fibers, and the like, or combinations thereof. In some embodiments, the refractory fibers are ceramic fibers made of mineral wool, zirconia, titanate, alumino-silicate, silica, aluminosilicate chromia, alumina, and the like, or combinations thereof. An example of a particularly useful ceramic fiber is FIBERFRAX® ceramic fiber, which is an alumino-silicate fiber that is commercially available from Unifrax, LLC. Another example of a particularly useful high temperature refractory fiber, and one that overcomes the aforementioned EC regulatory issues, is flexible low bio persistent (LBP) fibers. Examples of such LBP fibers include alkaline earth silicate fibers, specifically a combination of about 50-82 wt. % silica fibers, and about 18-43 wt. % of a 50/50 combination of calcium and magnesium fibers, that were designed for low pulmonary bio persistence. Commercially available versions of these fibers include INSULFRAX® available from Unifrax and SUPERWOOL® 607 available from Morgan Thermal Ceramics.

It will also be understood by one of ordinary skill in the art that not all glass fibers, for instance, are considered "high temperature refractory fibers." As used herein, "high temperature refractory fibers" means those refractory fibers that are able to withstand continuous use at temperatures at least as high as 2012° F. (1100° C.), alternatively at least as high as 2300° F. (1260° C.), alternatively at least as high as 2600° F. (1430° C.), alternatively at least as high as 3002° F. (1650° C.), or alternatively at least as high as 3272° F. (1800° C.). An example of a high temperature refractory fiber that can withstand temperatures between about 3002° F. (1650° C.) and about 3272° F. (1800° C.) is polycrystalline alumina bulk fiber. In addition, as would be understood by one of ordinary skill in the art, many glass fibers include fluxing agents, such as sodium, to lower the melting point of the silica base. Such fibers would not be suitable as high temperature refractory fibers as set forth herein.

In an embodiment, the high temperature refractory fibers are at least "partially cleaned" to remove shot from the fibers after the fibers have been pulped. In an embodiment, the high temperature refractory fibers are partially cleaned in process after pulping the fibers, but before formation of the nonwoven web. By "partially cleaned" what is meant is that the shot content is removed such that the shot content remaining is present in an amount less than about 50%. Known methods for separation of shot from the ceramic fibers include cone classifiers, liquid cyclones, drag classifiers, rake and spiral classifiers, bowl desilters, hydroseparators, solid-bowl centrifuges, and counter-current classifiers. In some embodiments, the ceramic fibers are partially cleaned such that greater than about 5% and less than about 50%, alternatively about 10% to about 40%, alternatively about 10% to about 30% shot, remains in the fibers prior to pulping, such shot having been removed using a hydrocyclone. Without intending to be bound by the theory, it is believed that this particular method of at least partially cleaning (cyclonic cleaning) also affords an amount of fiber distribution, which allows for more uniformity of fibers in the formed web.

Nonlimiting examples of thermoplastic resins useful in forming the thermoplastic fibers include but are not limited to polyester, polypropylene (PP), polyamide (nylon), acrylic polymer, and the like, or combinations thereof. Examples of polyesters include polyethylene terephthalate (PET), coPET, polyethylene (PE), polybutylene terephthalate (PBT), high density polyethylene (HDPE), low density polyethylene (LDPE), and the like, or combinations thereof. In some embodiments, the thermoplastic fibers include bicomponent fibers. In an embodiment, the bicomponent fiber has a co-polyester sheath and a polyester core, and the melting temperature of the sheath is lower than the melting temperature of the core. In other embodiments, the sheath is coPET and the core is PET, such as those commercially available from Advansa B.V. under the brand ADVANSA™ 271P. The bicomponent fibers are typically characterized by having a size of about 0.5 to about 10 denier, and a length of about 0.1 to about 50 millimeters. In some embodiments, the bicomponent fiber is an order of magnitude larger in size than the refractory fiber. In other embodiments, the bicomponent fiber replaces at least about 40% of binder.

In an embodiment, the nonwoven material includes a binder, typically in the form of a latex binders and/or binder fibers. The binder could be an inorganic binder, organic binder, and the like, or combinations thereof. In some embodiments, the organic binders are polymer compositions, such as compositions formed of phenolics, acrylics, epoxies, and the like, or combinations thereof. Examples of polymer binders include Styrene-Butadiene-Rubber (SBR), Styrene-Butadiene-Styrene (SBS), Ethylene-Vinyl-Chloride (EVCl), Poly-Vinylidene-Chloride (PVdC), modified Poly-Vinyl-Chloride (PVC), Poly-Vinyl-Alcohol (PVOH), Ethylene-Vinyl-Actate (EVA), and Poly-Vinyl-Acetate (PVA). According to an aspect, about 0.1-5 wt. % PVOH binder fiber, such as KURALON™ fibers, commercially available from Kuraray America, Inc., is present in the nonwoven material, which can provide mechanical stability and impart a suitable stiffness, since mechanical strength and/or stiffness experienced when longer and/or friable fibers are utilized, may otherwise compromise the material. In an alternative embodiment, only the latex binder is eliminated, while in other embodiments, only the binder fiber is eliminated. In yet further embodiments, the nonwoven material is "binderless." That is, the use of an additional latex binder and/or binder fiber has been eliminated completely.

One advantage of minimizing or eliminating the use of latex binders is that such compositions are typically combustible, (due to the amount of organics present in the binder), meaning that the resulting nonwoven material also has a level of combustibility. In an embodiment, the nonwoven material has a combustibles specification of less than about 10% as determined by measuring organics content by weighing a test specimen both before and after exposure to a muffle furnace set to 1500° F. (815.6° C.). Depending on the specific use of the material, having lower organics/combustibles may be advantageous in some embodiments. In some embodiments, materials with a Loss on Ignition (as defined hereinbelow—LOI) less than about 12% may be advantageous, alternatively less than about 8%.

The nonwoven materials according to an aspect are thicker than materials currently available for use as insulating materials. It is well understood by those of ordinary skill in the art that ceramic blankets having a thickness of about 0.25 inches is a typical thickness in the industry, which are quite thin. Prior to the concepts presented herein, it has been difficult to make thicker blankets due to the friability of the fibers, such as ceramic fibers. It has advantageously been determined that nonwoven materials according to an aspect are capable of being formed as described herein in which the material has a thickness of about 0.4 in. (1.02 cm) to about 1.0 in. (2.54 cm), alternatively about 0.5 in. (1.27 cm) to about 0.75 in. (1.91 cm). Such materials find particular utility as drapeable and wrappable materials, that is, as materials capable of enclosing or being wrapped, folded, wound, molded or bound around an object to provide, for instance, an insulative or noise-abating effect. According to an embodiment, such materials are capable of being formed in place.

According to an aspect, the nonwoven materials are capable of being made into blankets, boards, papers, mats, molded components, ropes, braids, cloths, tapes and the like and composites thereof. Advantageously, such materials have reduced impact on workers charged with handling the materials, due to the lower degree of static, as well as reduced likelihood that the refractory fibers break and become airborne, thus causing skin, respiratory or other irritation. Furthermore, such nonwoven materials are capable of being recycled after having been used, for instance, on an appliance, at least because of the improved "hand" of the product due to the nature of the highly flexible and resilient media.

In an embodiment, the nonwoven material has a basis weight of about 100 gsm to about 1200 gsm, a machine direction (MD) tensile strength of at least about 1000 g/in (393.7 g/cm) and a MD stiffness of at least about 3000 mg. In a further embodiment, the MD stiffness does not exceed 10,000 mg and the MD tensile strength does not exceed 6000 g/in. (2362.2 g/cm). Alternatively, the nonwoven material has a basis weight of about 600 gsm to about 1000 gsm.

In an embodiment, the nonwoven material includes one or more strengthening layers in order to provide varying degrees of strength depending on the intended application. Such strengthening layers are well known to those having ordinary skill in the art and include but are not limited to scrims, foams, aluminum foil, thin polyethylene layers, and the like, or combinations thereof. It was found, in fact, that in an embodiment, the nonwoven material was capable of thermally binding to aluminum foil without the use of adhesive, which is a beneficial cost and process savings enhancement.

According to an aspect and in an embodiment, the nonwoven material is capable of passing a UL94 flame retardancy standard of V-0. That is, given a sample of material having a length of 5 in (125 mm), a width of 0.5 in (13 mm) and a thickness of ⅛ in. (3.0 mm), multiple specimens (typically 5) are tested after conditioning for a certain time period, while a blue 20 mm high flame is applied to the center of the lower edge of the specimen for 10 seconds and removed. If burning ceases within 30 seconds, the flame is reapplied for an additional 10 seconds. If the specimen drips, particles are allowed to fall onto a layer of dry absorbent surgical cotton placed 300 mm below the specimen. To pass under the V-0 requirement, the specimens many not burn with flaming combustion for more than 10 seconds after application of the test flame. In addition, the total flaming combustion time may not exceed 50 seconds for each specimen. Further, the specimens may not burn with flaming or glowing combustion up to the holding clamp, may not drip flaming particles that ignite the dry absorbent and may not have glowing combustion that persists for more than 30 seconds after the second removal of the test flame.

Aside from modifying the system pH, as contemplated herein, it is possible to effectively modify density of the nonwoven material by introducing various shaped fibers. As spinning technology becomes more sophisticated, thermoplastic binder fibers, including bicomponent fibers, are provided in progressively more ornate fiber arrangements. Some examples of these novel geometries useful herein include: flat, gear-shaped, barbell-shaped, trilobal-shaped and other geometries as would be understood by those skilled in the art. These fibers have either a higher or lower hydraulic diameter for a given mass of fiber. Manipulation of hydraulic fiber diameter will affect the apparent density of the sheet.

According to an aspect, the nonwoven material is made using a wet-laid process, as would be understood by one of ordinary skill in the art. Such a process includes pulping the high temperature refractory fiber with the bicomponent fiber to form a fiber mixture, and then suspending the pulped fiber mixture in an aqueous solution to form a suspension. The thus-formed suspension may then be pumped into a headbox of a rotoformer, MiniMill or other wetlaid forming machines such as a fourdrinier, deltaformer and the like, to form a nonwoven web. The thus-formed nonwoven web, according to an aspect, may subsequently be sprayed with the latex binder and dried to create a nonwoven material having an overall binder content not to exceed about 9%. Alternatively, the nonwoven material remains binderless by not applying the latex binder.

In an embodiment, the refractory fibers are pulped with the thermoplastic fibers prior to creating the nonwoven material.

Application of a hydrophobic compound to the nonwoven materials according to an aspect can be accomplished during the formation process, prior to the drying process, or after the material has been formed or dried. Non-limiting examples of water repellent compounds that could be used to improve durability in the water jet cutting process include but are not limited to: fluorinated polymers, (including, but not limited to, fluoroacrylates), silane polymers, silicone polymers, and waxes. Typically, such compounds will be present in the nonwoven material in an amount of about 0.5-10 wt. %.

EXAMPLES

Various embodiments will be described in greater detail in the following examples wherein the various embodiments are for purposes of illustration, and not for purposes of limitation, of the broader aspects of the presently presented concepts.

Various testing procedures were conducted for each of the examples as follows:

Basis Weight (B.W.): T.A.P.P.I. procedure T-410, reported in pounds per 3,000 square feet (Lbs./3 kSF) and grams per square meter (gsm), Basis Weight of Paper and Paperboard Used a Molten Basis Weight Scale, Model PE 6000. An alternative test for measuring basis weight can be used according to ASTM D646.

Thickness (Caliper): T.A.P.P.I. procedure, T-411, "Thickness (Caliper) of Paper and Paperboard," at 4 pounds per square foot (psf) (0.2 kPa), reported in mils and millimeters (mm). Used an Enco Gage No. 605-4070 with base 653 having a modified 4 inch×4 inch (101.6×101.6 mm) plate.

LOI %: Loss On Ignition (LOI) is the measure of the amount of organics (or combustibles) present in the composition, which as mentioned above is a test that subjects the test specimen to high temperatures for a predetermined amount of time 10 minutes, and weights of the sample are recorded both before the test is conducted, and afterwards. The LOI is recorded as a percentage of weight loss (LOI %=Final Weight/Initial Weight*100%). Materials with a LOI greater than about 12% are said to be combustible.

MD Tensile Strength: T.A.P.P.I. procedure T-494, "Tensile Breaking Properties of Paper and Paperboard" was used to test mechanical strength of the exemplary materials, and was measured in terms of machine direction (MD) tensile strength (stress) using an Instron Testing Machine, reported in g/in. In this test, a specimen (dimension: 10 in.×1 in. (25.4 mm×25.4 mm) was stretched at a predetermined rate (1 in/min./(25.4 mm/min.)) until breakage. The tensile strength was calculated from maximum load or force (in grams) applied in breaking the material divided by the original cross-sectional area of the test piece (in linear inches/(cm)).

MD Stiffness: T.A.P.P.I. procedure T-543, "Stiffness of Paper" reported in milligrams, using a Gurley type stiffness tester.

Double Fold Tensile Strength (g/in/(g/cm)): The Double Fold Tensile Strength is a test designed to indicate the foldability of the material. Thus, the test specimen was folded prior to conducting the MD Tensile Strength, and the results are similarly reported in g/in.

SAD (Bulk Density): The SAD is a ratio of basis weight in pounds per three thousand square feet divided by thickness in mils at four pounds per square foot. This value can be multiplied by four, so as to be reported in pounds per cubic foot (lbs/ft$^3$) or kilograms per cubic meter (kg/m$^3$).

Wet Tensile Strength: T.A.P.P.I. procedure T-456, "Tensile Breaking Strength of Water-Saturated Paper and Paperboard" was used to test mechanical strength of wetted exemplary materials, (the materials were submersed in deionized water for 60 seconds until saturated), and was measured using an Instron Testing Machine, reported in g/in. In this test, a specimen (dimension: 10 in.×1 in. (254 mm×25.4 mm) was stretched at a predetermined rate (1 in/min./(25.4 mm/min.)) until breakage. The wet tensile strength was calculated from maximum load or force (in grams) applied in breaking the material divided by the original cross-sectional area of the test piece (in linear inches/(cm)).

Comparative Example

Approximately 100 lbs. (45.4 kg) of PG 111 staple ceramic fibers (alumina-silica fibers), commercially available from Thermal Ceramics, were pulped with 1 lb. (453.6 g) of binder fiber from KURALON™ VPB 105—2.4 mm, (a synthetic fiber made of polyvinyl alcohol (PVOH)), commercially available from Kuraray America, Inc., and suspended in 1350 gallons (5110 liters) water solution. This suspension was then pumped into a headbox of a rotoformer, without partially cleaning shot, as would be understood by one of ordinary skill in the art, and wet-laid and collected onto a screen to form a nonwoven web. The thus-formed nonwoven web was subsequently sprayed with latex binder having about 10.5% 26120 Acrylic suspended in water, commercially available from Lubrizol Hycar, and dried to create a nonwoven material having an overall binder content of approximately 10%.

Four variations (Examples 1-4) were produced during a trial wherein the nonwoven material was made using the conventional wet-laid process essentially as described above, with the exception that shot was partially cleaned and binder was either eliminated or reduced. As an example, while two streams of ceramic fiber were pumped into the headbox, only one stream was treated in-line using a hydrocyclone to remove shot at a removal efficiency of about 80%. Using a mass-balance calculation, two assumptions were made to calculate the percentage of shot present in the final nonwoven material as follows: 1. shot was present in the ceramic fiber at a ratio of about 1:1; and 2. fiber was removed at about 15% efficiency of the shot removal efficiency.

In the Examples 1-4, FIBERFRAX® ceramic fiber, (alumino-silicate fiber), commercially available from Unifrax, LLC were partially cleaned as described hereinabove and combined with Advansa 2.2T bicomponent fibers (coPET sheath/PET core), having a 2.2 denier size and 6 mil chop length, commercially available from Advansa B.V. The thus-formed nonwoven webs were cured in the dryer at temperatures ranging between about 300 to about 400° F. (149-205° C.). Where indicated, the thus-formed web was subsequently sprayed with the Acrylic latex binder, (as mentioned above with respect to the Comparative Example), to create the nonwoven material having the indicated weight percentage of binder. The ratio of ceramic fiber/bico fiber/latex binder used for each Example is set out in Table 1, while the results of testing of the comparative example and the nonwoven materials according to an aspect are set forth in Table 2.

TABLE 1

Sample Content

| | Comparative Example 970 LK | Example 1: 970LK-BF Bico only | Example 2: 970LK-BF 50-50 | Example 3: 970LK-BF 50-50 Low Combustibles | Example 4: 970LK-BF 60-40 |
|---|---|---|---|---|---|
| Ceramic Fiber wt. % | 49.9 | 60.3 | 60 | 61 | 60.4 |
| Bicomponent Fiber wt. % | 0 | 6.94 | 3.48 | 2.88 | 3.8 |
| Binder wt. % | 10.1 | 0 | 3.87 | 2.87 | 2.87 |
| Moisture content % | <1 | <1 | <1 | <1 | <1 |
| Shot Content % | 40 | 32.8 | 32.6 | 33.2 | 32.9 |

TABLE 2

Test Results

| | Comparative Example 970 LK | Example 1: 970LK-BF Bico only | Example 2: 970LK-BF 50-50 | Example 3: 970LK-BF 50-50 Low Combustibles | Example 4: 970LK-BF 60-40 |
|---|---|---|---|---|---|
| Basis Weight (Lbs./3kSF & (gsm)) | 495.6 (806.6 gsm) | 396.2 (644.8 gsm) | 388.5 (632.3 gsm) | 370.5 (603.0 gsm) | 386.9 (629.7 gsm) |
| 4 psf thickness (mils & (mm)) | 260.7 (6.6 mm) | 215.3 (5.5 mm) | 193.8 (4.9 mm) | 193.5 (4.9 mm) | 197.8 (5.0 mm) |
| LOI (%) | 10.1 | 6.95 | 7.35 | 5.75 | 6.68 |
| MD Tensile (g/in & (g/cm)) | 11249 (4428.7 g/cm) | 1171 (461 g/cm) | 5347 (2105.1 g/cm) | 3344 (1316.5 g/cm) | 4546 (1789.8 g/cm) |
| MD Stiffness (mg) | 13303 | 3000 | 10000 | 7850 | 8325 |
| Double fold tensile (g/in & (g/cm)) | 7801 (3071.3 g/cm) | 1035 (407.5 g/cm) | 3572 (1406.3 g/cm) | 2318 (912.6 g/cm) | 6818 (2684.3 g/cm) |
| 4 psf SAD (lb/ft$^3$ & (kg/m$^3$)) | 7.6 (121.6 kg/m$^3$) | 7.36 (118 kg/m$^3$) | 8 (128 kg/m$^3$) | 7.64 (122.4 kg/m$^3$) | 7.84 (125.6 kg/m$^3$) |

Of the four variations (Examples 1-4), only Example 3 experienced minor checking and cracking. This failure occurred on the 3 inch (76.2 mm) wide linear encoder roll of the rotoformer turret winder. The absence of cracking despite the numerous tight turns in the turret winder is a drastic improvement over the Comparative Example. The 970LK product is typically not run on the rotoformer for this very reason. But even on a traditional rotoformer, material cracking can be vexing and lead to great deal of scrap and waste material both on the dry-end and in finishing.

Contrary to the typical cracking behavior, the trial material of Example 1, wherein no binder was used, was so flexible that knots could be tied with 1 inch (25.4 mm) wide strips. It is important to note, that the dramatic increase in pliability led to a far less stiff material. To combat this, the 50-50 formulation of Example 2 was made, where a very small amount of binder was sprayed on the material, in addition to using bicomponent fiber to form the web. Example 2 was stiff, pliable, and strong—all with a 7% LOI, rather than the standard 10% LOI of the Comparative Example. The low combustibles formulation, Example 3, targeted an LOI of 5% with the same 50-50 compositions of bicomponent fiber and binder. This roll was still strong, though not quite as strong as Example 2. The material of Example 3 exhibited minor signs of failure, as discussed in detail above, in the turret winder in the form of checking/cracking. Since the failures occurred only on the extremely tight turns of the turret winder it would likely not occur on a production-grade rotoformer, where the smallest radius is typically about 6 inches (152.4 mm).

While it is noted that tensile strength is an order of magnitude lower in Example 1 as compared to the Comparative Example, such tensile strengths would still likely be sufficient for commercialization. In other words, having such high tensile strengths as found in the Comparative Example are not likely necessary to customers. Similarly, a reduction in stiffness has the benefit of being easier to die cut, while maintaining cohesion.

A costing analysis was conducted using most recent commercial runs (ten in total) of 970 LK (commercially available under the LYTHERM® brand from Lydall, Inc.) at current latex yield. It was found that approximately $2100 USD in raw material savings for a 5000 pound (2268 kg) run could be achieved for the 50-50 formulation (Example 2), and $2800 USD per run with the bicomponent only formulation (Example 1).

According to the following Examples, a water-based furnish was made using the components as indicated in Table 3 hereinbelow, and the resulting furnish was made into a handsheet as would be understood by one of ordinary skill in the art (each sheet had an area of 0.131 $m^2$ (1.40 $ft^2$)). The thus-formed handsheets were cured in a dryer at temperatures ranging between about 300 to about 400° F. (149-205° C.).

Example 5

Approximately 93 wt. % (65.35 g) of SUPERWOOL® 112 fibers (Alkaline Earth Silicate (AES) wool fibers), commercially available from Morgan Thermal Ceramics, were hand pulped with 7 wt. % (4.89 g) of a thermalbonding (sheath-core type) polyester binder fiber (type 4080, 2 denier×5 mm, about 15 μm in diameter), commercially available from Unitika Co., to form a handsheet having a total weight of 70.24 g.

Example 6

Approximately 92.9 wt. % (65.28 g) of SUPERWOOL® 112 fibers, were hand pulped with 7 wt. % (4.89 g) of Unitika 4080, 0.1 wt. % (0.1 g) KURALON® PVOH binder fiber, and 2 wt. % UNIDYNE™ TG-5502 water and oil repellent, fluorocarbon fabric protection system (30% solid content), fluoropolymer commercially available from Daikin America, Inc., to form a handsheet. The ratio of components used for each Example is set out in Table 3, while the results of testing of the materials according to an aspect are set forth in Table 4.

TABLE 3

| Sample Content (wt. %) | | |
|---|---|---|
| | Example 5: | Example 6: |
| AES Wool Fiber | 93 | 91.04 |
| Bicomponent Fiber | 7 | 6.82 |
| Binder Fiber | | 0.14 |
| Fluoropolymer | | 2.00 |

TABLE 4

| Test Results | | |
|---|---|---|
| | Example 5: | Example 6: |
| Basis Weight (Lbs./3kSF & (gsm)) | 337.9 (550.4 gsm) | 344.4 (561.0 gsm) |
| 8 psf thickness (mils & (mm)) | 67.0 (1.702 mm) | 81.1 (2.059 mm) |
| 4 psf thickness (mils & (mm)) | 108.5 (2.756 mm) | 113.0 (2.87 mm) |
| Tensile (g/in. & (g/cm)) | 862.5 (339.6 g/cm) | 2071.0 (815.4 g/cm) |
| SAD ($lb/ft^3$ & ($kg/m^3$)) | 12.5 (200.2 $kg/m^3$) | 12.2 (195.8 $kg/m^3$) |
| LOI (%) | 12.1 | 12.1 |
| Wet Tensile (g/in. & (g/cm)) | 605.0 (238.2 g/cm) | 1603.0 (631.1 g/cm) |

Thus, without compromising the flexibility of the tested sheets, it was found that addition of a fluoropolymer to the material including a high temperature refractory fiber, bicomponent fiber, and only a minor amount of binder fiber, results in a strong (dramatically improved tensile strength from 339.6 to 815.4 g/cm), yet flexible sheet made according to an embodiment, while being able to withstand wet jet cutting procedures since the wet tensile strength was also dramatically improved (from 238.2 to 631.1 g/cm).

The components and methods illustrated are not limited to the specific embodiments described herein, but rather, features illustrated or described as part of one embodiment can be used on or in conjunction with other embodiments to yield yet a further embodiment. It is intended that the material and method include such modifications and variations.

While the material and method have been described with reference to various embodiments, it will be understood by those skilled in the art that various changes may be made and equivalents may be substituted for elements thereof without departing from the scope contemplated. In addition, many modifications may be made to adapt a particular situation or material to the teachings found herein without departing from the essential scope thereof.

In this specification and the claims that follow, reference will be made to a number of terms that have the following meanings. The singular forms "a," "an" and "the" include plural referents unless the context clearly dictates otherwise. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent . . . 95 percent, 96 percent, 97 percent, 98 percent, 99 percent, or 100 percent. Moreover, any numerical range defined by two R numbers as defined in the above is also specifically disclosed.

As used in the claims, the word "comprises" and its grammatical variants logically also subtend and include phrases of varying and differing extent such as for example, but not limited thereto, "consisting essentially of" and "consisting of."

Advances in science and technology may make equivalents and substitutions possible that are not now contemplated by reason of the imprecision of language; these variations should be covered by the appended claims. This written description uses examples to disclose the material and method, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

Accordingly, the scope of protection is not limited by the description set out above but is only limited by the claims which follow, that scope including all equivalents of the subject matter of the claims. Each and every claim is incorporated into the specification as an embodiment hereof. Thus, the claims are a further description and are an addition to the detailed description described herein. The disclosures of all patents, patent applications, and publications cited herein, if any are hereby incorporated by reference.

What is claimed is:

1. An insulating material, comprising:

high temperature refractory fibers comprising at least one of ceramic fibers, glass fibers, silica fibers or alumina fibers and the refractory fibers being capable of withstanding continuous use at temperatures at least as high as 2012° F.; and thermoplastic fibers, wherein the insulating material is a wrappable, wet-laid, binderless nonwoven material.

2. The insulating material of claim 1, wherein the high temperature refractory fibers are at least partially cleaned and the nonwoven material has a shot content of up to about 50%.

3. The insulating material of claim 1, wherein the thermoplastic fibers comprise bicomponent fibers.

4. The insulating material of claim 3, wherein the bicomponent fibers comprise a co-polyester sheath and a polyester core, and the melting temperature of the sheath is lower than the melting temperature of the core.

5. The insulating material of claim 3, wherein the nonwoven material comprises:

at least about 5-95 wt. % of the high temperature refractory fiber; and at least about 1-10 wt. % of the bicomponent fibers.

6. The insulating material of claim 1, wherein the material has a combustibles specification of less than about 10%.

7. The insulating material of claim 1, wherein the material has a basis weight of at least about 600 gsm, a MD tensile strength of at least about 1000 g/in (393.7 g/cm) and a MD stiffness of at least about 3000 mg.

8. The insulating material of claim 1 wherein a thickness of the nonwoven material is about 0.4 in. (10.2 mm) to about 1.0 in. (25.4 mm).

9. The insulating material according to claim 1, wherein the insulating material comprises a MD tensile strength of less than 2106 g/cm, a MD stiffness of less than 10001 mg, and a double fold tensile strength of less than 2685 g/cm.

10. The insulating material according to claim 1, wherein the insulating material comprises a MD tensile strength of less than 4428 g/cm, a MD stiffness of less than 13303 mg, and a double fold tensile strength of less than 3071 g/cm.

11. An insulating material, comprising:

at least about 5-95 wt. % high temperature refractory fibers comprising at least one of ceramic fibers, glass fibers, silica fibers or alumina fibers and the refractory fibers being capable of withstanding continuous use at temperatures at least as high as 2012° F.;

at least about 1-10 wt. % of bicomponent fiber; and an amount of latex binder or binder fiber not to exceed about 9 wt. %, wherein the nonwoven material has a shot content of less than about 50%, and wherein a thickness of the nonwoven material is about 0.4 in. (10.2 mm) to about 1.0 in. (25.4 mm), wherein the insulating material is a wrappable, wet-laid, nonwoven material.

12. The insulating material of claim 11, further comprising a fluorinated polymer.

13. The insulating material claim 11, wherein the material has a combustibles specification of less than about 10%.

14. The insulating material of claim 11, wherein the material has a basis weight of at least about 600 gsm, a MD tensile strength of at least about 1000 g/in (393.7 g/cm) and a MD stiffness of at least about 3000 mg.

15. The insulating material of claim 11, wherein the bicomponent fiber has a co-polyester sheath and a polyester core, and the melting temperature of the sheath is lower than the melting temperature of the core.

16. The insulating material of claim 11, further comprising about 0.1-5 wt. % PVOH binder fiber.

17. An insulating material, comprising:

high temperature refractory fibers comprising at least one of ceramic fibers, glass fibers, silica fibers or alumina fibers and the refractory fibers being capable of withstanding continuous use at temperatures at least as high as 2012° F.; and thermoplastic fibers, wherein the insulating material is a wrappable, wet-laid, nonwoven material and wherein the insulating material comprises a MD tensile strength of less than 2106 g/cm, a MD stiffness of less than 10001 mg, and a double fold tensile strength of less than 2685 g/cm.

18. The insulating material of claim 17, further comprising about 0.1-5 wt. % PVOH binder fiber.

19. The insulating material according to claim 17, further comprising:

a polymer binder fiber not to exceed about 9 wt. %.

* * * * *